US008389930B2

(12) United States Patent
Ugarov

(10) Patent No.: US 8,389,930 B2
(45) Date of Patent: Mar. 5, 2013

(54) INPUT PORT FOR MASS SPECTROMETERS THAT IS ADAPTED FOR USE WITH ION SOURCES THAT OPERATE AT ATMOSPHERIC PRESSURE

(75) Inventor: Michael Ugarov, San Jose, CA (US)

(73) Assignee: Agilent Technologies, Inc., Santa Clara, CA (US)

( * ) Notice: Subject to any disclaimer, the term of this patent is extended or adjusted under 35 U.S.C. 154(b) by 143 days.

(21) Appl. No.: 12/771,918

(22) Filed: Apr. 30, 2010

(65) Prior Publication Data

US 2011/0266432 A1 Nov. 3, 2011

(51) Int. Cl.
*H01J 49/26* (2006.01)

(52) U.S. Cl. ..... 250/281; 250/282; 250/288

(58) Field of Classification Search ..... 250/281
See application file for complete search history.

(56) References Cited

U.S. PATENT DOCUMENTS 5,998,215 A * 12/1999 Prather et al. ..... 436/173
6,818,889 B1 11/2004 Sheehan
7,462,822 B2 12/2008 Gebhardt et al. ..... 250/288
7,858,934 B2 * 12/2010 Belford et al. ..... 250/293
2004/0245458 A1 12/2004 Sheehan
2007/0097162 A1 * 5/2007 Iwashita et al. ..... 347/9
2011/0147576 A1 * 6/2011 Wouters et al. ..... 250/282
2011/0192969 A1 * 8/2011 Verentchikov ..... 250/282

FOREIGN PATENT DOCUMENTS

WO WO 2009/143623 A1 12/2009

OTHER PUBLICATIONS

International Search Report, GB1105221.4, Jul. 29, 2011, all pages.

* cited by examiner

*Primary Examiner* — Phillip A Johnston

(57) ABSTRACT

A mass spectrometer and method for operating the same. The mass spectrometer includes a vacuum chamber and an input port that receives ions to be analyzed in the mass spectrometer. The chamber is adapted to operate at a pressure less than a first pressure, and includes a wall that separates the chamber from an environment outside the chamber at atmospheric pressure. The input port provides a pressure drop between the outside environment at a second pressure and the chamber. The input port includes a plurality of channels, each channel having first and second electrodes arranged on opposing surfaces of that channel and having first and second ends. The first end of each channel is at a pressure equal to the first pressure and the second end is at a pressure less than the second pressure.

20 Claims, 14 Drawing Sheets

INPUT PORT FOR MASS SPECTROMETERS THAT IS ADAPTED FOR USE WITH ION SOURCES THAT OPERATE AT ATMOSPHERIC PRESSURE

BACKGROUND OF THE INVENTION

Mass spectrometers separate ions based on the charge-to-mass ratio of the ions. A compound that is to be analyzed utilizing a mass spectrometer must first be ionized. The ionization process can also lead to the breakup of the compound into a number of ions whose relative abundances in the mass spectrometer spectrum are indicative of the type of compound. Ionization sources that operate at atmospheric pressure are useful in the analysis of many compounds of interest. However, such sources require some form of interface between the ion source and the vacuum of the mass spectrometer to preserve the vacuum within the mass spectrometer.

Typically, the interface is a capillary tube having one end that samples ions from the ion source and the other end in the mass spectrometer. The efficiency with which ions are moved from the ion source to the mass spectrometer through such a tube is low due to the size of the tube and losses in the tube. In addition, if the tube is constructed from a dielectric, ions that are absorbed onto the surface of the tube can create a space charge that hinders the transit of ions of the same charge through the tube.

Alternatively, a small orifice is used to limit the flow between the source and the mass spectrometer. In this case, the efficiency of ion collection is also low because the diameter of the orifice must be small to preserve the vacuum within the mass spectrometer.

Further, the sample of interest is often dissolved in a solvent that is vaporized in the ion source. The carrier solvent and gases used in the ion source to vaporize the solvent can result in unwanted ions that lead to undesirable background species in the mass spectrometer.

SUMMARY OF THE INVENTION

The present invention includes a pressure interface that is adapted for use in mass spectrometers or other instruments that operate at reduced pressure but must receive ions that are generated at higher pressures. The pressure interface includes a plurality of channels that have electrodes on the walls thereof that allow the channels to be used for filtering the ions in addition to providing the interface between the two environments that are different pressures. When used to filter the ions, the electrodes are powered to provide an alternating electric field in the channels.

DETAILED DESCRIPTION OF THE PREFERRED EMBODIMENTS OF THE INVENTION

Figure 1:
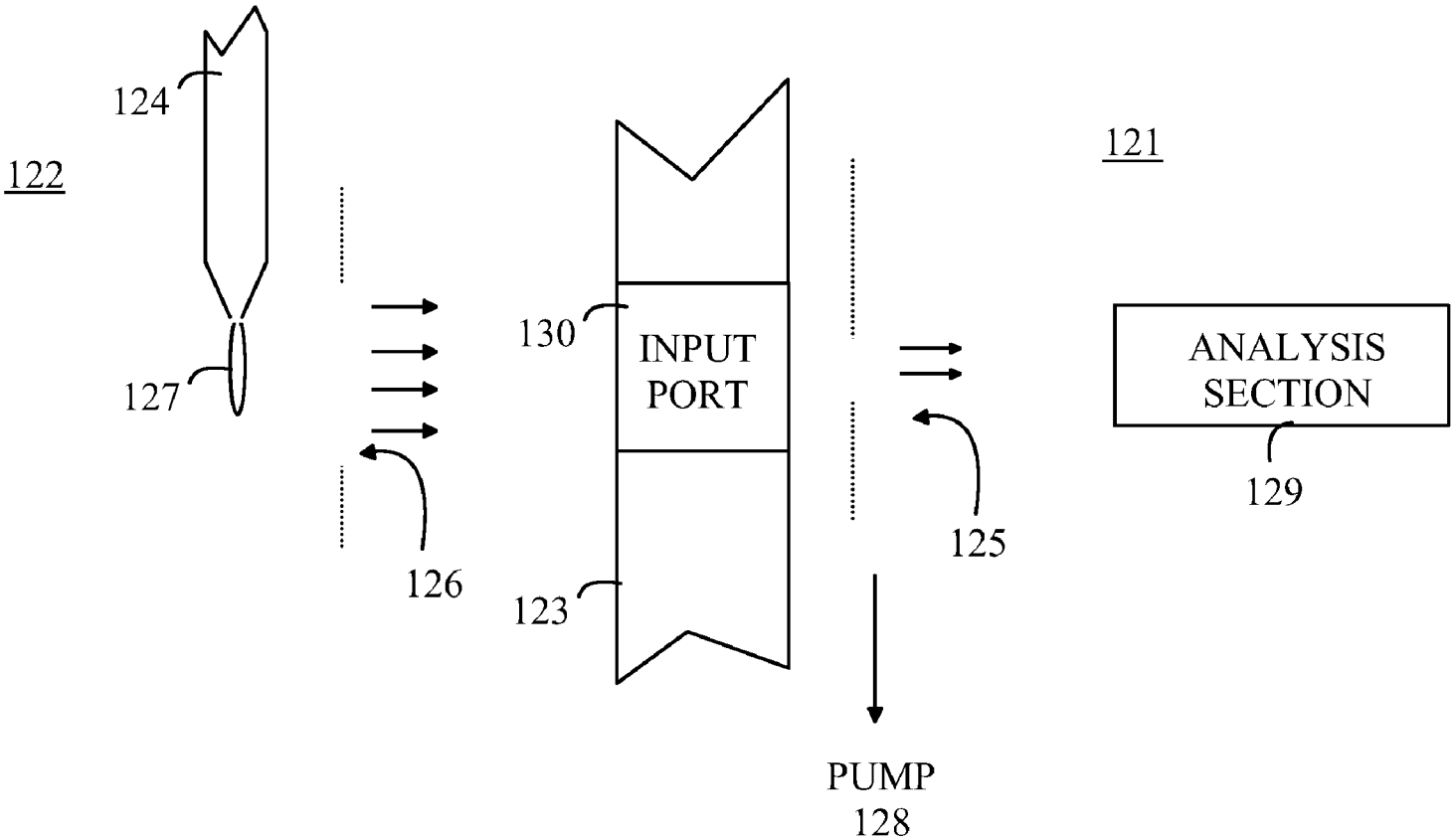
FIG. 1 illustrates an analysis system in which ions generated by ion source 124 operating at atmospheric pressures are analyzed by a mass spectrometer that operates at a highly reduced pressure.

The manner in which the present invention provides its advantages can be more easily understood with reference to FIG. 1, which illustrates an analysis system in which ions generated by ion source 124 operating in a region 122 at atmospheric pressure are analyzed by a mass spectrometer 121 that operates at a reduced pressure. Ion source 124 is an electro-spray source in this example. A solvent containing the chemical species of interest is sprayed through a nozzle and generates an ion plume 127 in response to a potential difference between ion source 124 and the wall 123 of mass spectrometer 121. Ion source 124 can be characterized by an ion source output aperture 126 through which ions generated in plume 127 exit in a direction toward mass spectrometer 121. Mass spectrometer 121 is characterized by an input acceptance aperture 125 within the mass spectrometer that defines the area through which ions must enter the analysis section 129 of the mass spectrometer to be properly analyzed. An input port 130 in the mass spectrometer wall provides the interface between aperture 126, which is at atmospheric pressure and aperture 125, which is at a reduced pressure. One goal of an input port is to match the output of the ion source to the input of the mass spectrometer such that as high a fraction of the ions that exit the source output aperture are directed into the input acceptance aperture of the mass spectrometer. The amount of gas that leaks through input port 130 must be less than the maximum gas flow that can be removed by pump 128 without substantially altering the direction of the ions that are entering mass spectrometer 121.

Figure 2:
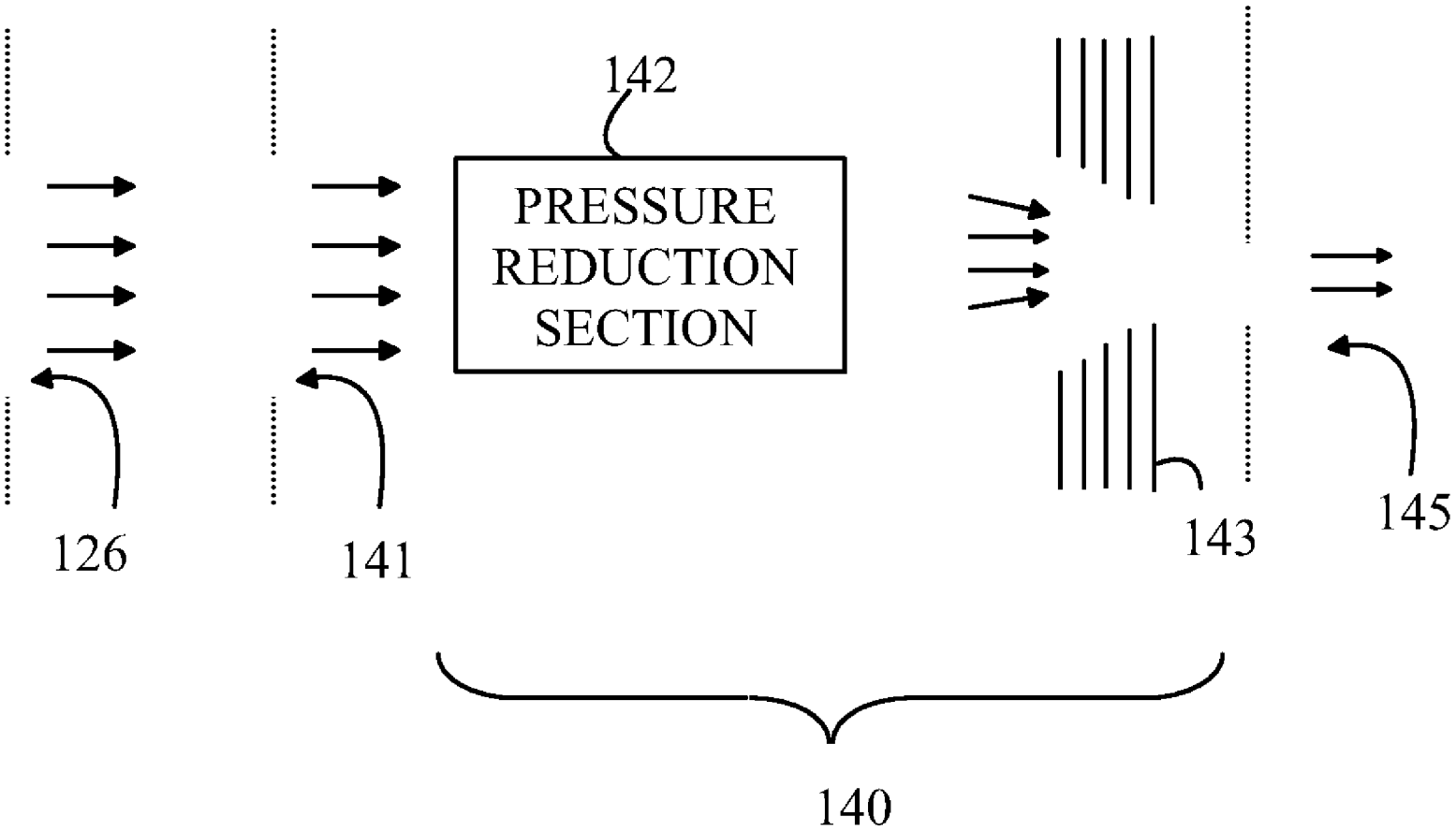
FIG. 2 illustrates an input port according to one embodiment of the present invention.

Input port 130 must restrict the flow of gas to a value less than the maximum gas flow while interfacing aperture 126 to aperture 125. For many systems of interest, aperture 126 is significantly larger than aperture 125. Hence, either a significant fraction of the ions generated by ion source 124 must be discarded or input port 130 may provide a concentrating function such that the ions leaving aperture 126 are "funneled" into aperture 125. Ion concentrators that operate at atmospheric pressure present significant design problems. Hence, many prior schemes use a small aperture input port, such as a capillary tube, to sample the ions leaving aperture 126 and accept the resultant loss in efficiency. Refer now to FIG. 2, which illustrates an input port according to one embodiment of the present invention. Input port 140 has a pressure reduction section 142 that is characterized by an input aperture 141 and an output aperture 145. Input aperture 141 is chosen to have a size comparable to that of the output aperture 126 of the ion source. The output of pressure reduction section 142 is an ion beam having substantially the same size as that arriving through input aperture 141. The output beam from pressure reduction section 142 is in the low pressure environment inside the mass spectrometer, and hence, may be concentrated. The input beam is concentrated by electrodes 143 of the ion concentrating optics to a size that is substantially the same size as the input aperture to the mass spectrometer analysis section that is maintained at low pressure as discussed above.

The pressure at the input side of the port is substantially equal to the atmospheric pressure or lower, but preferably above 30 Torr. The output side of the port is at a pressure less than the pressure of input side, and preferably below 30 Torr.

Figure 3:
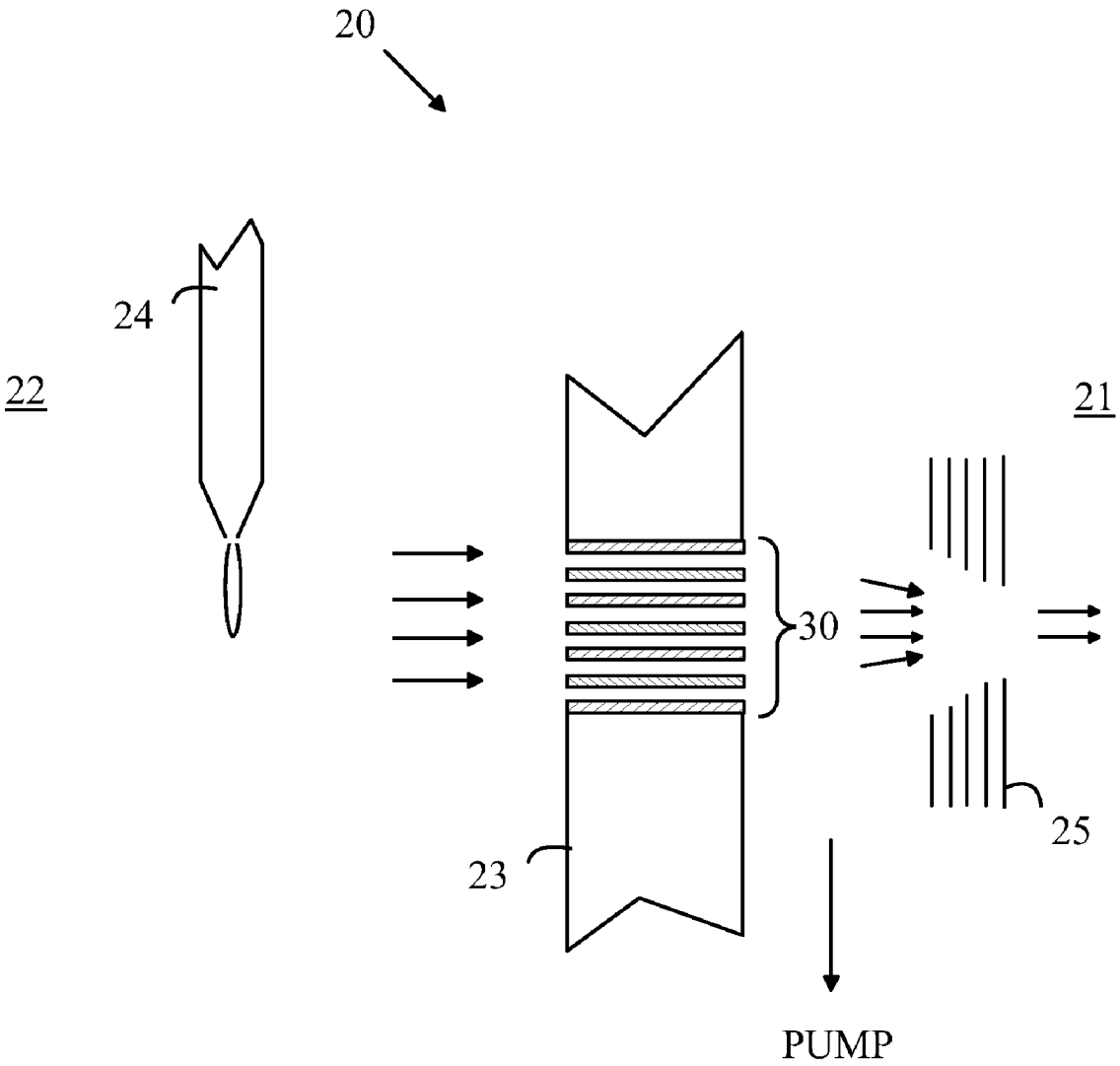
FIG. 3 is a cross-sectional view of an analysis system that utilizes a pressure reduction section according to one embodiment of the present invention.

Refer now to FIG. 3, which is a cross-sectional view of an analysis system that utilizes a pressure reduction section according to one embodiment of the present invention. Analysis system 20 includes an ion source 24 and a mass spectrometer having an interior low-pressure chamber 21 that is separated from the outside environment 22 by a wall 23 in which input port 30 is located. Ions from an ion source 24 are swept into input port 30 by the pressure differential across wall 23. Chamber 21 is maintained at a reduced pressure by a vacuum pump that compensates for the gases input through input port 30. The dimensions of input port 30 are chosen such that the desired flow of gas through the channels of the port is achieved and the vacuum pump can maintain the desired pressure differential across wall 23 while not significantly interfering with the flow of ions into the analysis section of the mass spectrometer. In this embodiment, the mass spectrometer includes a set of electrodes 25 that concentrate the incoming ion beam.

Figure 4:
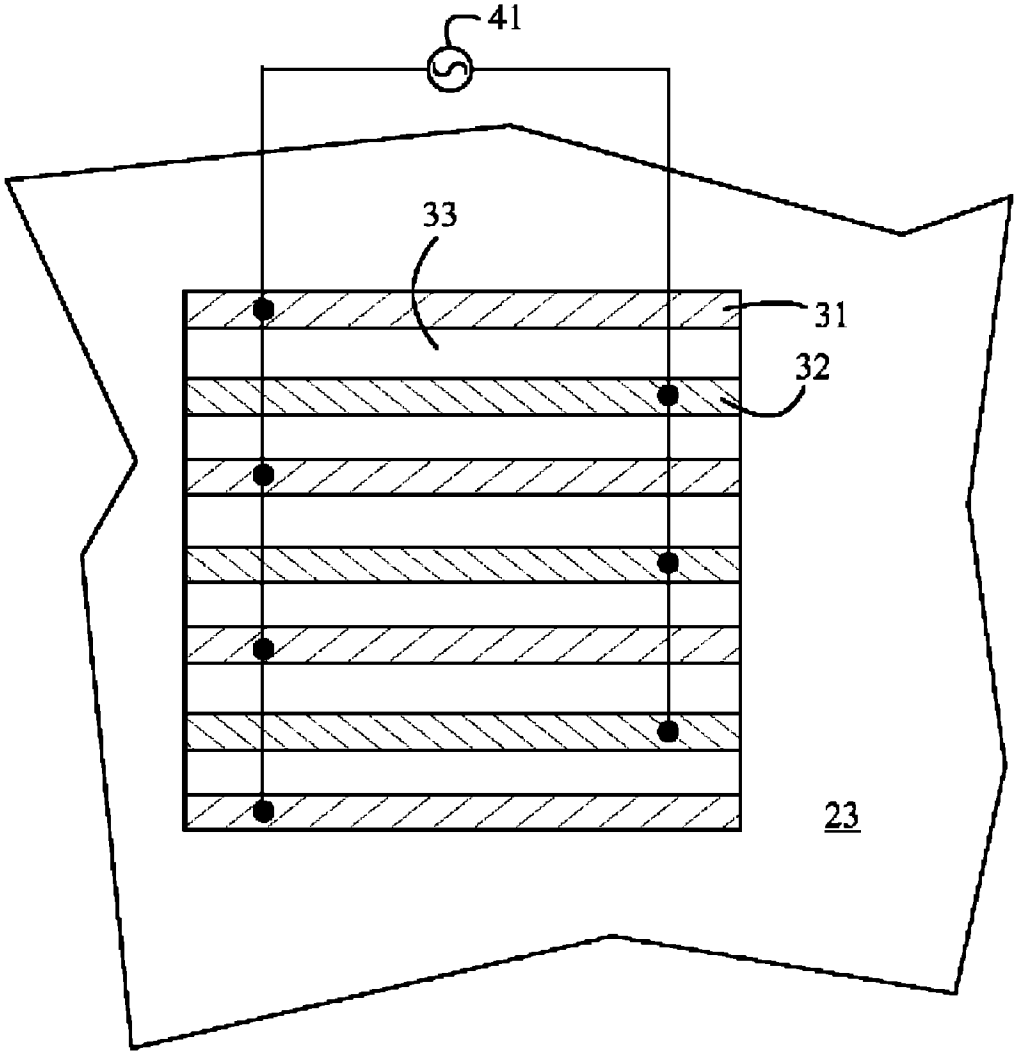
FIG. 4 is an end view of input port 30.

Refer now to FIG. 4, which is an end view of input port 30. Input port 30 includes a plurality of planar electrodes that are located inside rectangular channels through which the ions pass. Exemplary electrodes are shown at 31 and 32. A typical channel is shown at 33. The electrodes are connected to a power source 41 that controls the potential on the electrodes. The potential waveform can be AC, DC, or AC with a DC component as discussed below. Since the electrodes are conductors that are tied to a potential source, the space charge accumulation problems created by capillary tubes that have dielectric walls are substantially reduced in this embodiment.

The electrodes can be tied to a fixed and/or time-varying electric potential source. When the time-varying potential source is utilized, the electrodes can be used to separate the ions prior to the entry of the ions into the mass spectrometer by utilizing voltage patterns analogous to those used in field asymmetric waveform ion mobility spectrometers. This type of separation is based on the observation that the drift speed of many ions of interest in an electric field is non-linear with respect to the field strength. This phenomenon can be used to separate ions having the same charge-to-mass ratio, and hence, can provide separation based on a different criterion than the mass spectrometer. The ions that pass through the electrode structure depend on the voltage pattern applied to the electrodes.

Figure 5:
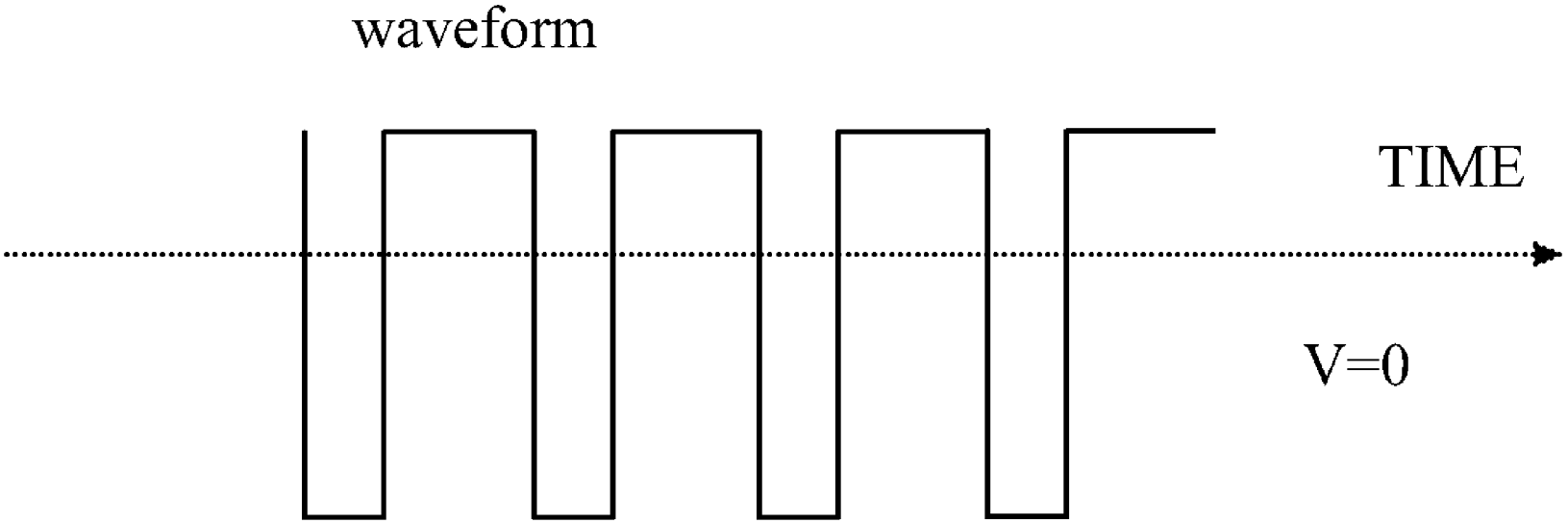
FIG. 5 illustrates one voltage pattern that can be used to separate the ions prior to the ions entering into the mass spectrometer.

Refer to FIG. 5, which illustrates one voltage pattern that can be used to separate the ions prior to the ions entering into the mass spectrometer. This pattern is provided between each pair of adjacent electrodes. The pattern is an alternating voltage, typically in the RF range, in which the duration of one polarity is longer then the other polarity. The amplitudes in both polarities are set unequal so that the average voltage is equal to zero. In practice, the AC signal can be capacitively coupled across each pair or electrodes.

If the mobility of ions were always proportional to the electric field, all ions would be subjected to zero average force from the field, and would travel through the channel while oscillating in transverse direction. In fact, due to the aforementioned nonlinearity, ions get deflected and may hit the walls of the channel A DC bias is applied between the electrodes such that only ions with specific relationship between ion mobility and field strength are transmitted. The remaining ions are absorbed onto the electrode surfaces. A two-dimensional analysis can be provided by sweeping the bias through a predetermined range and analyzing each group of ions that enters into the mass spectrometer using the mass spectrometer to separate the ions based on charge-to-mass ratio.

If the ion separation based on high field ion mobility is not required for a specific analysis, the alternating RF voltage can be turned off, and the ions are simply travelling through the channels with the flow of gas. Fewer ions are therefore lost on the walls of the channels, and the highest sensitivity of the mass spectrometer based analysis can be achieved.

The above-described embodiments utilize an input port that is part of the wall of the vacuum containment vessel of the mass spectrometer. However, it should be noted that the port could be provided in a removable form such that different input ports can be utilized for different types of analysis and/or ion sources. The different input ports can vary in terms of the width, length, shape, number and density of the channels. These parameters affect the flow rate through the input port, and hence, provide a mechanism for matching the desired input flow into the mass spectrometer with the flow needed to efficiently provide ions from the ion source. By adjusting these parameters, the port can be optimized to provide a desired gas flow rate, ion collection area, and ion separation by high field ion mobility. In one aspect of the invention, the channel width is chosen to be between 20 μm and 600 μm and the channel lengths are chosen to be between 0.3 mm and 100 mm. The total open cross-sectional area can be as large as 10 $mm^2$.

It should be noted that field asymmetric waveform ion mobility separation electrodes are typically operated with both ends of the channels at a pressure that is close to atmospheric pressure. That is, the pressure gradient across the separation electrodes is small. In the above-described embodiments, the pressure gradient across the channel can be much greater since one end of the channel can be at atmospheric pressure while the other end is at the pressure of the vacuum chamber of the mass spectrometer. As a result, there can be a continuous variation of gas pressure, temperature and velocity along the length of the channel, which could adversely affect the resolution of the ion separation and the rate of transmission for ions with specific mobility values.

This is due to the fact that the high field ion mobility separation effects are dependent on the ratio between the electric field and the gas density (E/N). If the pressure along the channel is changing significantly, the E/N ratio is changing as well and the AC field effect on the ion motion is changing. This can lead to instability in the trajectories of the ions that need to reach the mass spectrometer.

This potential problem can be mitigated by providing an arrangement in which the pressure drop experienced during the separation of the ions is only a fraction of the total pressure drop between the ion source and the interior of the mass spectrometer, or alternatively, E/N ratio is maintained substantially constant by adjusting the field strength E along the length of the channels.

Figure 6:
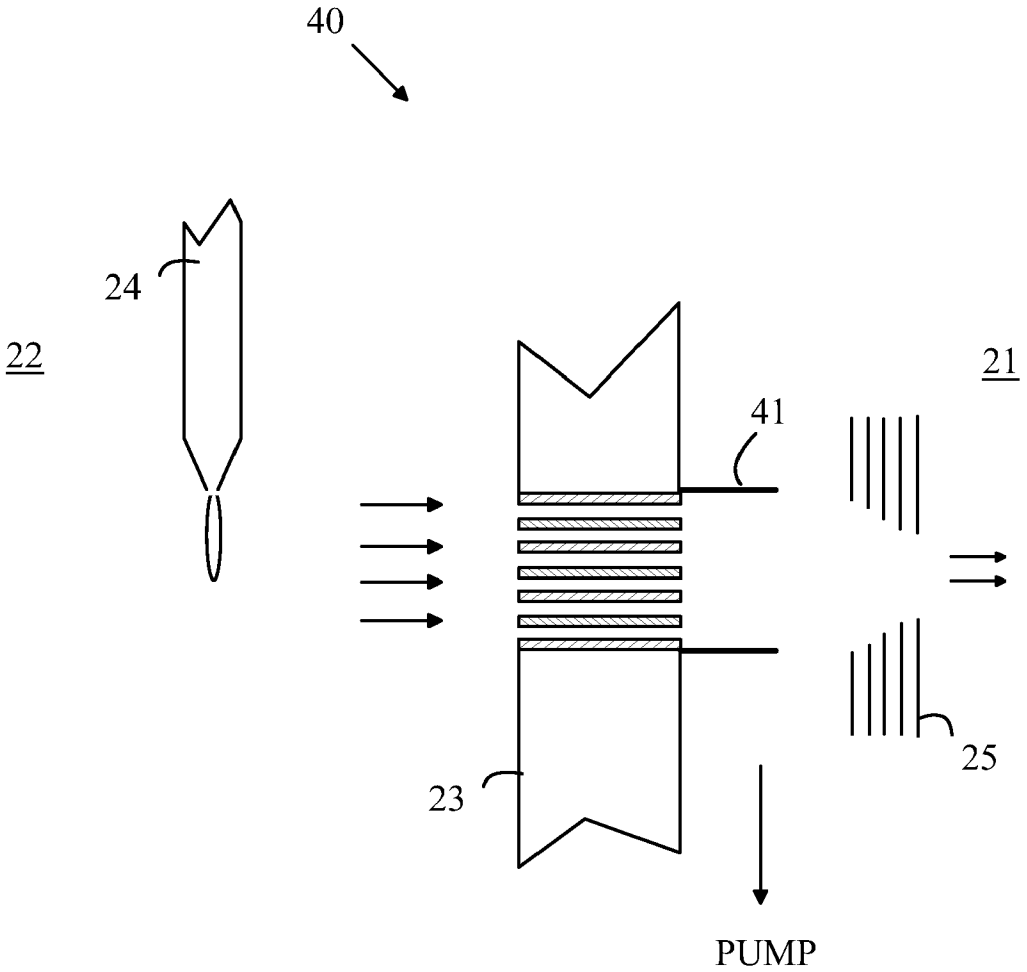
FIG. 6 is a cross-sectional view of another embodiment of a mass spectrometer according to the present invention.

One method for reducing the pressure gradient in the separation portion of the channels is to provide an extension of the input port within the mass spectrometer such that a portion of the pressure drop occurs within the extension, and hence, the portion of the pressure drop across the separation channels is reduced. Refer now to FIG. 6, which is a cross-sectional view of another embodiment of a mass spectrometer according to the present invention. Mass spectrometer 40 differs from mass spectrometer 20 discussed above with reference to FIG.

3 in that an extension 41 of the input port extends into the interior of the mass spectrometer. The pressure drop across the separation channels is reduced by the pressure drop between the end of the separation channels and the interior 21 of the mass spectrometer.

Figure 7A:
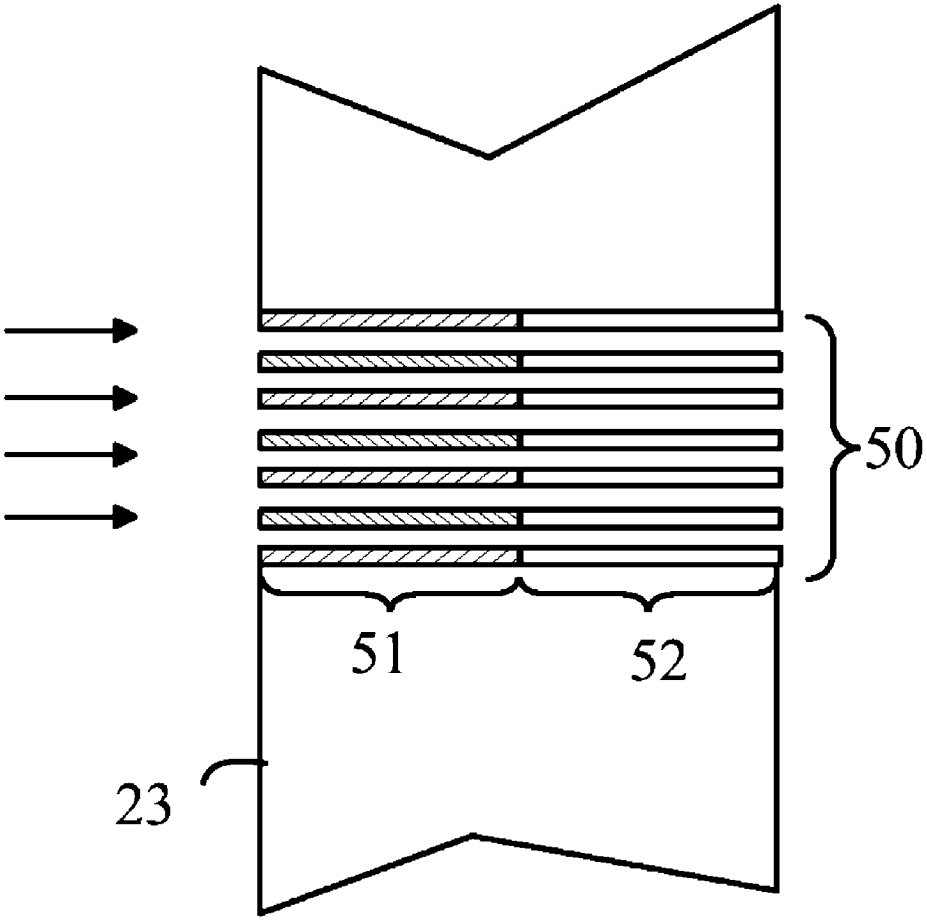
FIGS. 7A-7F illustrate different forms of channel geometries that can be utilized in the present invention.

While the embodiment shown in FIG. 6 provides some reduction of the pressure drop across the separation channels, the fraction of the pressure drop across the separation channels is still more than half of the total pressure drop, since the cross-sectional area of extension 41 is much greater than the sum of the cross-sectional areas of the separation channels. Refer now to FIG. 7A, which illustrates another embodiment of an input port according to the present invention. Input port 50 differs from input port 30 discussed above in that the electrodes within the separation channels to which the RF potential is applied only extend over a portion of the length of the channels as shown at 51. The remainder of each channel, which is shown at 52, is a drift channel that absorbs a portion of the pressure drop so that the pressure drop across portion 51 is significantly reduced.

Figure 7B:
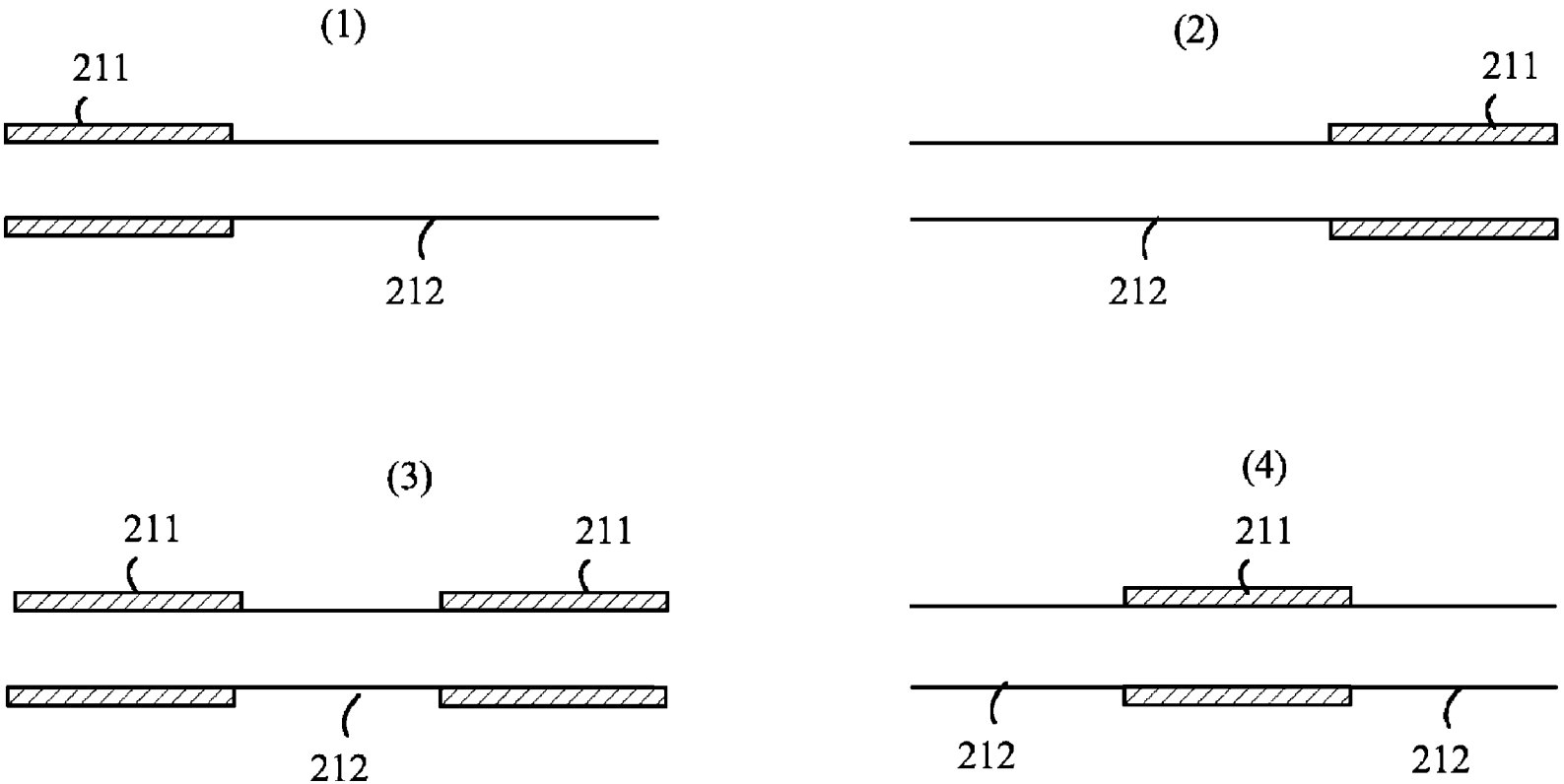

FIG. 7B illustrated a number combinations of sections of individual channels with and without active electrodes. The sections with the separation electrodes are labeled 211, and the drift regions are labeled 212. The channel arrangement shown at 7B(1) provides considerable pressure drop in section 212, which is nearest to the mass spectrometer. The channel arrangement at 7B(2), on the other hand, provides the significant pressure drop on the side of the ion source.

In fact, ion separation based on high field asymmetric waveform ion mobility spectrometry can have some advantages when operated at pressures less than atmospheric. In particular, higher value of the ratio E/N can be obtained without risking electrical breakdown inside the channels. The channel arrangement shown in FIG. 7B(2) allows running the separation at such reduced pressure.

Refer now to FIG. 7B(3), which illustrates a channel with two electrode sections. The pressure in two sections is different due to the additional pressure drop in the middle section. Two independent ion separations can therefore be performed in these two sections by adjusting the parameters of the time-varying electric fields in each section. The arrangement shown in FIG. 7B(4) can be utilized to perform separations in the intermediate pressure ranges.

Figure 7C:
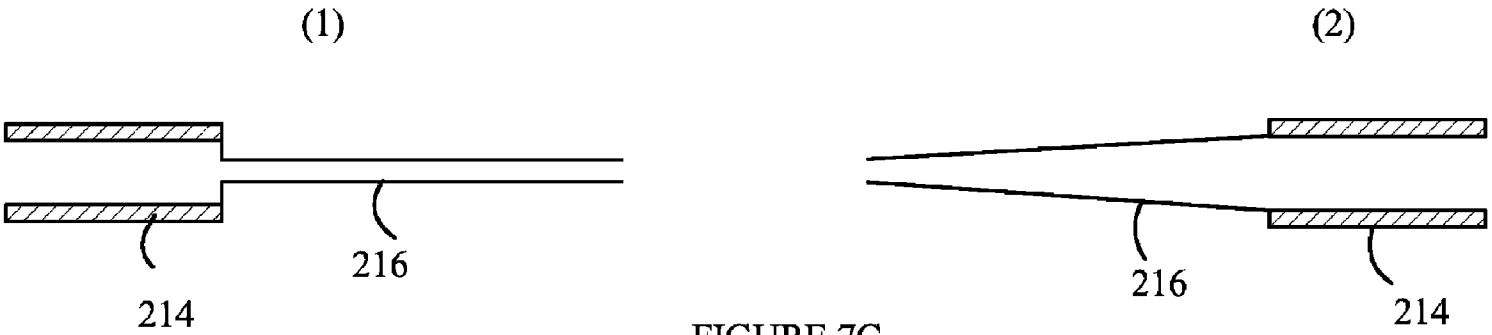

Specific pressure conditions in the ion mobility separating section of the channels can also be set by using sections of channels with varying cross sections, shapes and lengths. Longer sections with smaller cross sections will provide faster pressure drop due to smaller conductance. Refer now to FIG. 7C, which illustrates examples of channel geometries with varying cross sections. FIG. 7C(1) illustrates an arrangement in which the channel cross-section is reduced in the drift section 216 compared to the separation section 214. FIG. 7C(1) illustrates an arrangement in which the drift region has a cross-section that varies continuously to avoid abrupt changes in the channel cross-section that could give rise to turbulent flow and/or ion loss. It should be noted that the arrangements shown in FIGS. 7C(1) and 7C(2) can be combined to form channels that have sections that vary in cross-section between sections that have constant cross-sections with electrodes for ion separation.

Figure 7D:
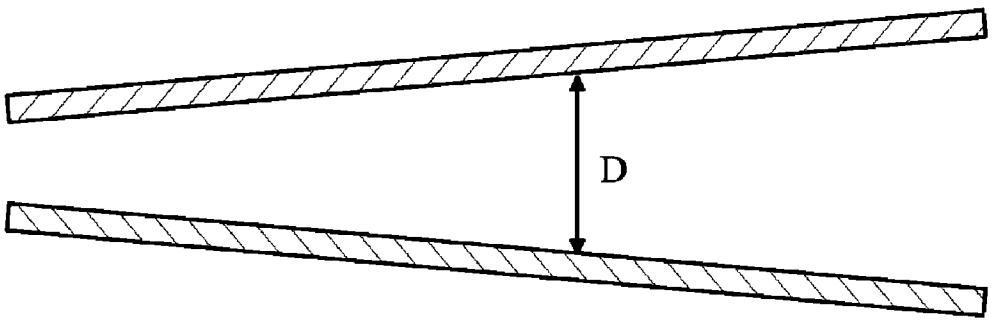

Problems associated with a significant pressure drop across the ion separation section can be further reduced by utilizing an arrangement in which the electric field also decreases as a function of distance along the channel such that changes in the ratio of electric field strength to gas density are reduced as a function of distance along the channel. One method for accomplishing this is to vary the distance between the electrodes in the ion separation section as shown in FIG. 7D. In this embodiment, the distance, D, between the electrodes increases as the ions move along the channel in the direction of the pressure and hence, the gas density decreases. As a result, the electric field also decreases along the channel. The rate of increase of D is chosen such that the ratio of the electric field to gas density is approximately constant.

Figure 7E:
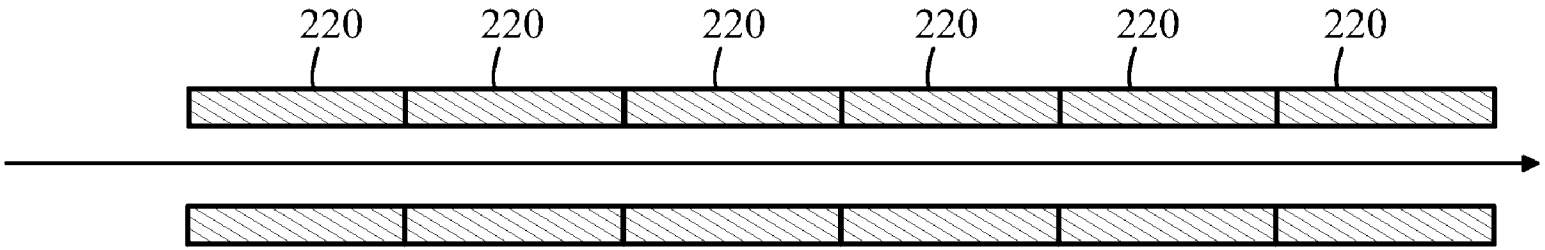
Figure 7F:
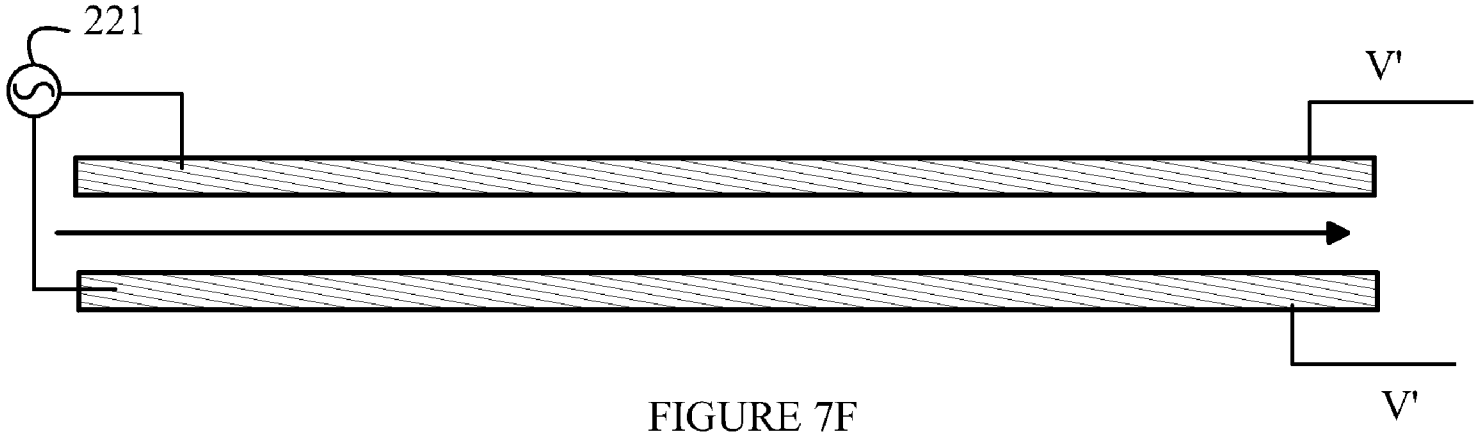

Another method for reducing the changes in electric field strength to gas density is to divide the electrodes into sections that are operated at different voltages such that the voltage decreases as a function of distance along the channel. Such an arrangement is shown in FIG. 7E, which illustrates one separation channel in which the electrodes are divided into sections 220 that are operated at different voltages. By adjusting the drive voltage amplitudes in the various sections, variations in field strength to gas density are reduced. The drive voltages along the channel can also be reduced as a function of distance along the channel by utilizing resistive electrodes and coupling the two ends of the channel electrodes to different voltage rails, as shown in FIG. 7F. In this arrangement, the time-varying waveform from generator 221 is coupled to the beginning of the channel electrode, while the ends of the channel electrodes are held at fixed potentials such that the drive signal amplitude decreases along the channel.

Figure 8:
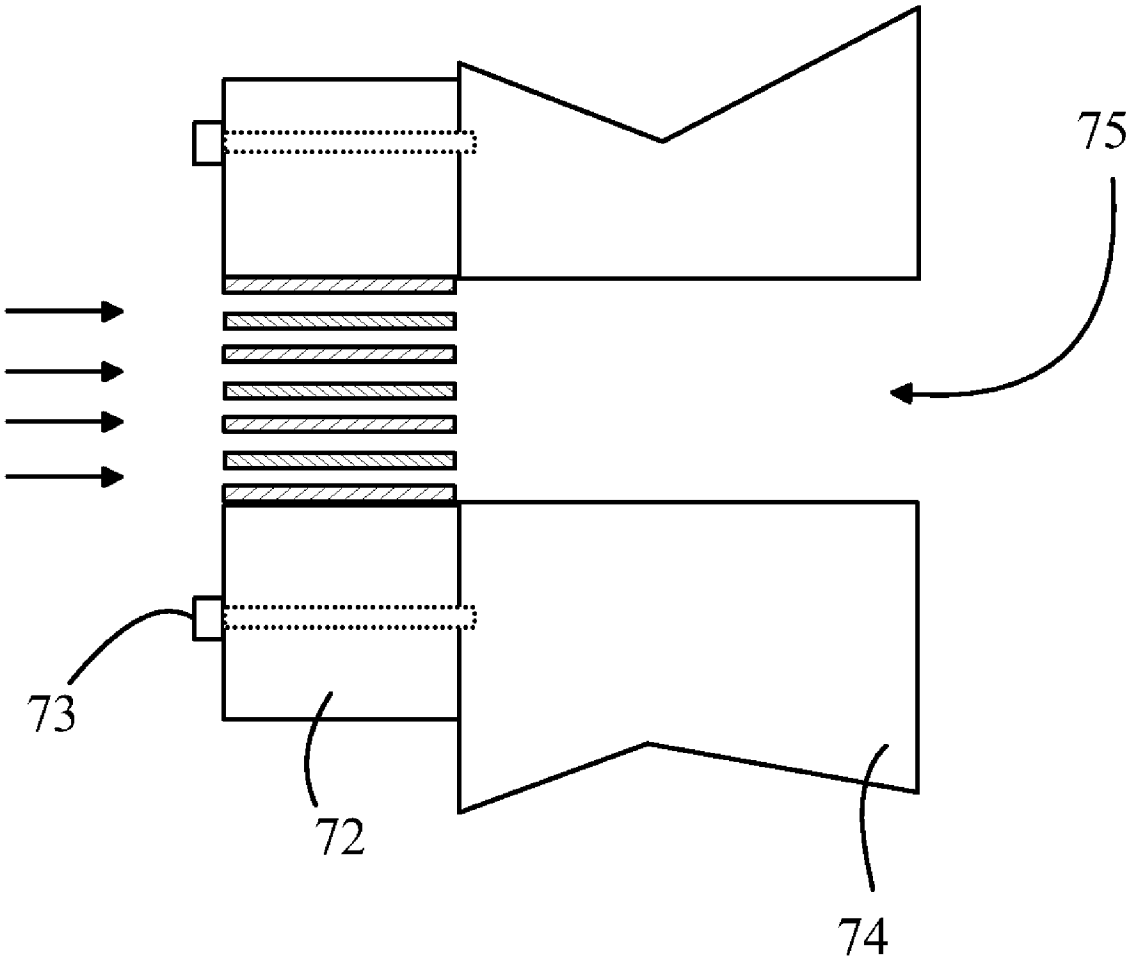
FIG. 8 is a cross-sectional view of a portion of a mass spectrometer wall 74 to which a channel plate 72 has been attached using fasteners 73.

The above-described embodiments of the present invention utilize a channel insert that resides in the wall of the mass spectrometer vacuum chamber. However, embodiments in which the channel plate is attached to the outside of the mass spectrometer wall can also be constructed. Refer now to FIG. 8, which is a cross-sectional view of a portion of a mass spectrometer wall 74 to which a channel plate 72 has been attached using fasteners 73. Wall 74 includes a passage 75 that can also provide the function of extension 41 discussed above with reference to FIG. 6. This arrangement allows different channel plates to be utilized in the input port depending on the requirements of particular ion sources. In addition, the removable channel plate allows for easy replacement of the channel plate when the plate becomes fowled with material from the ion source over time.

The above-described embodiments utilize conducting electrodes inside the channels through which the ions move. The electrodes could be solid metal, semiconductor, or coatings on an insulating substrate. If coatings are utilized, the electrodes can be constructed of a resistive material that is deposited on the substrate. The coatings can extend to the openings in the channels or be confined to the interior regions of the channels. In one aspect of the invention, the electrodes in each channel are operated in a manner that provides a DC potential gradient along the channel while maintaining a DC offset between the electrodes when the electrodes are operated in the manner described above to provide separation of the ions.

Figure 9:
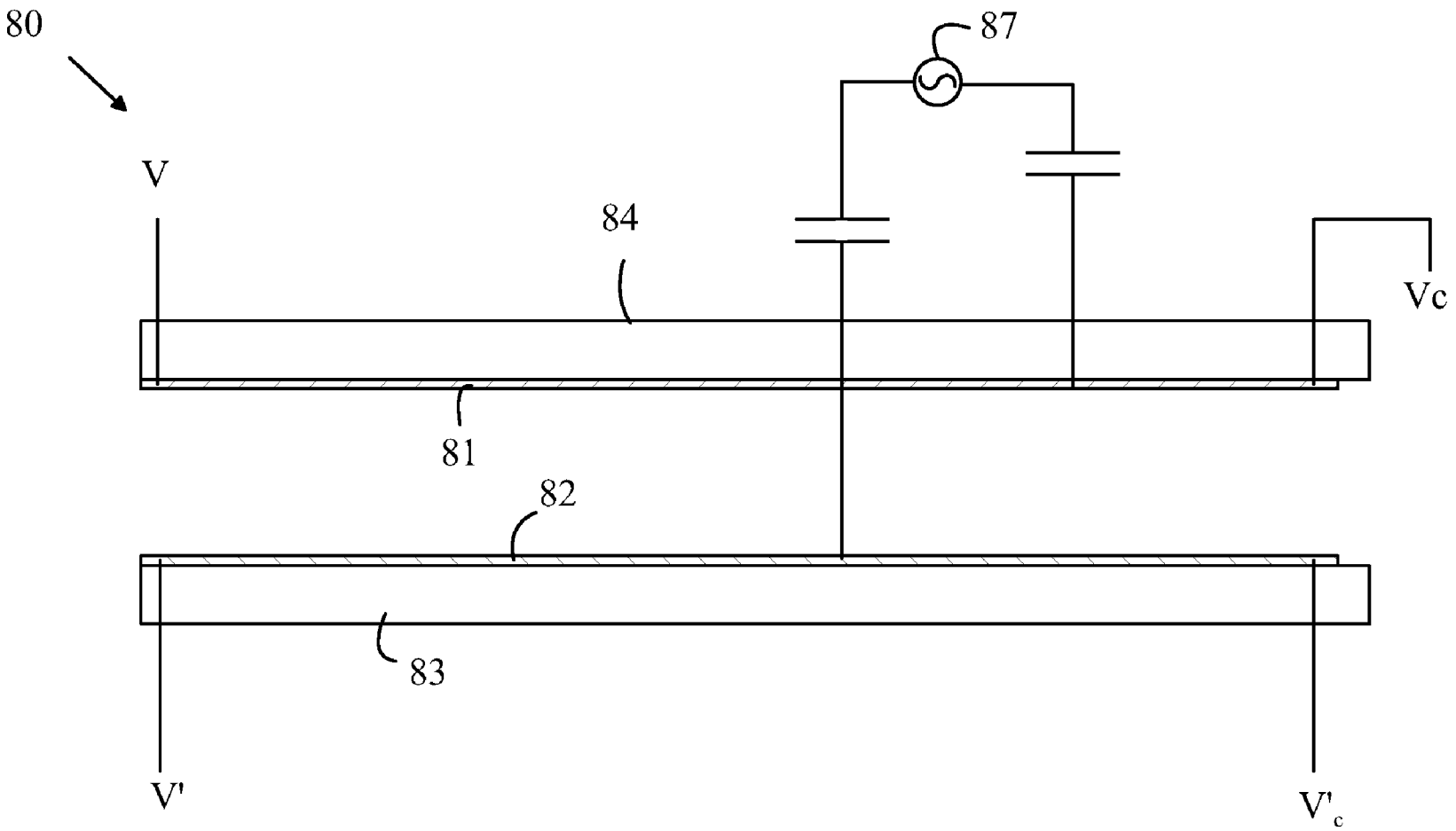
FIG. 9 illustrates one embodiment of a channel that can be utilized in the present invention.

Refer now to FIG. 9, which illustrates one embodiment of a channel that can be utilized in the present invention. The electrode inside channel 80 is constructed by coating the insulating walls of the channel with a conductive medium. In the case shown in FIG. 9, top wall 84 and bottom wall 82 are coated separately with resistive conductive layers 81 and 83, respectively. This allows the conductive coatings to be driven separately so that the channel can be used as a separation device as described above. When driven in the separation mode described above, source (V-V') is equal to (Vc-V'c) with (V-V') equal to the offset voltage. An AC source 87 capacitively couples the alternating voltage to electrodes layers 81 and 83. In this configuration, there is a DC voltage gradient along the length while the average potential at each point along the channel differs by the offset voltage.

In one aspect of the invention, the sign of the electric bias is chosen so that ions have to move with the gas flow against the action of the electric field. As a result, the entrance of the channel that is adjacent to the ion source can be maintained at high negative potential (for positive ions), while the source remains at or near ground. This simplifies the design of the source. In addition, this arrangement reduces the risk of shocks to the operator, since the electrodes can be offset into the channel sufficiently to prevent the operator from touching the end of the electrodes.

In another aspect of the invention, the walls of multiple channels are coated with the resistive material as described above and the ends of the channel electrodes are maintained at different potentials. The ends of the channels nearest the ion source are maintained at a potential that allows the ion source to be maintained at a potential that does not pose a hazard to a human operator while providing an electric field that attracts ions into the channels by the electrostatic forces and the gas flow. The other ends of the channels are maintained at a potential such that the ions must move out of the channel against the electric field forces using the gas flow to carry the ions into the mass spectrometer. This arrangement reduces the risk of electric shocks to personnel using the present invention. Ideally, the ion source is maintained at a potential that is at or near ground.

Figure 10:
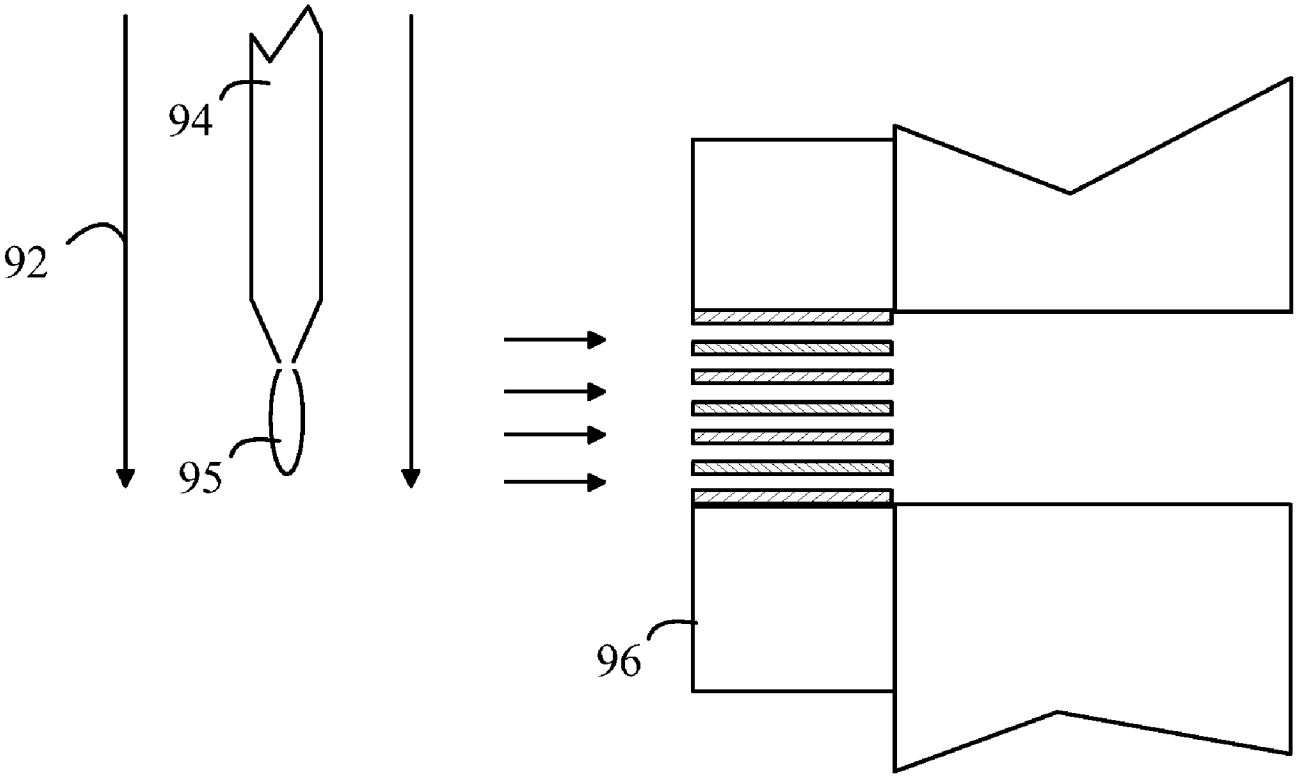
FIG. 10 illustrates the use of a spray ion source with the input port of the present invention.

An input port according to the present invention can be utilized with an electric spray ion source. In such ion sources, the chemical species of interest is dissolved in a carrier liquid that is sprayed out of a nozzle. Droplets of the carrier liquid can pose problems for the input port if these droplets reach the input port. This problem can be substantially reduced by utilizing an ion source that provides a concentric current of heated gas around the ion plume. Refer now to FIG. 10, which illustrates the use of a spray ion source with the input port of the present invention. Ion source 94 provides an ion plume 95 by spraying a liquid in which the chemical species of interest is dissolved. Droplets of the solvent that are not immediately vaporized are vaporized by a heated gas sheath 92 that flows concentrically about ion source 94 and plume 95. Sheath 92 reduces the number of droplets that can reach input port 96, and hence, reduces problems associated with such droplets being taken into the channels in the input port.

Figure 11:
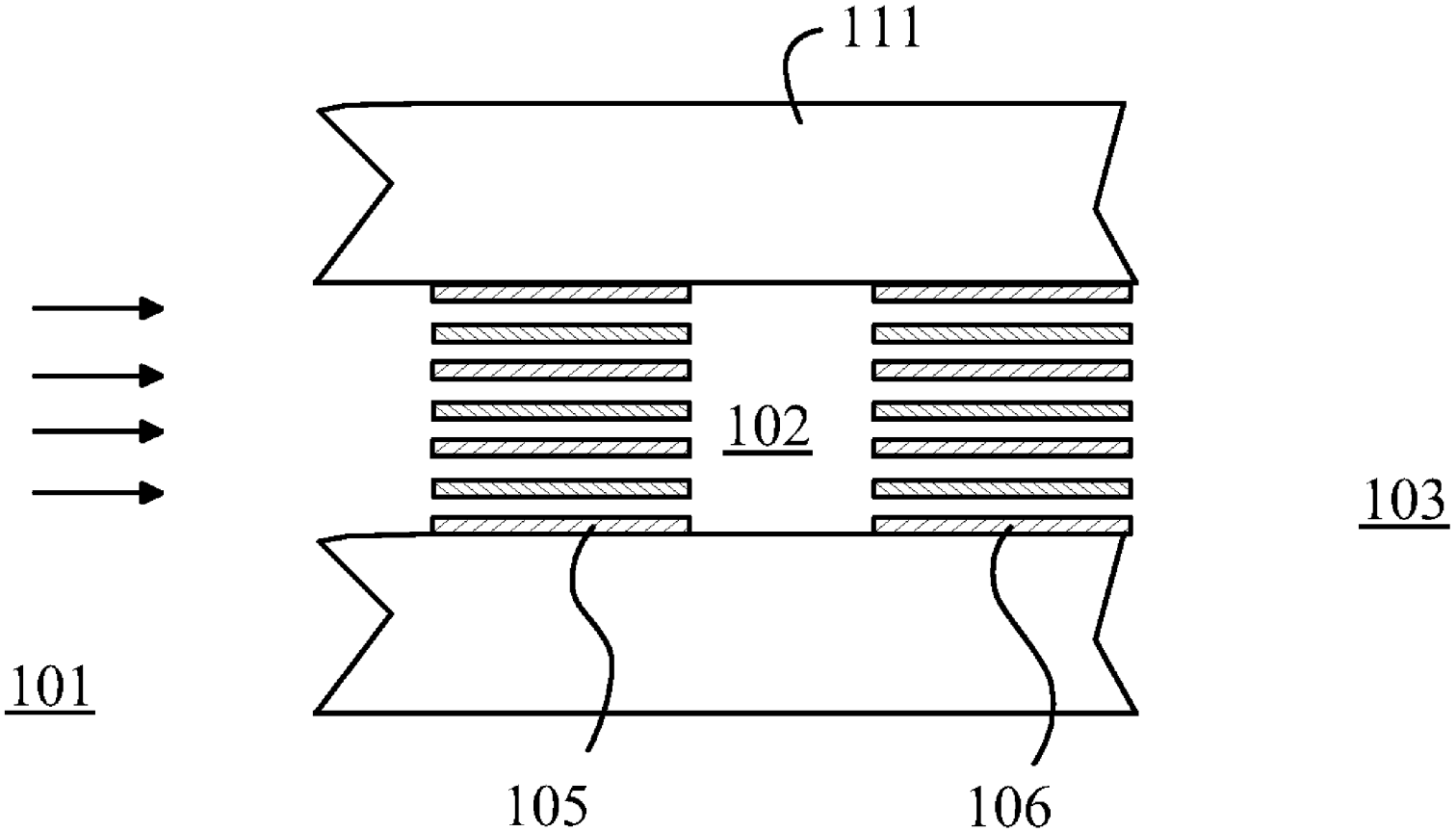
FIG. 11 illustrates an input port according to another embodiment of the present invention.

The above-described embodiments utilize an input port having a single set of channels to provide flow matching, pressure control, and optionally, ion separation between the ion source and the interior of the mass spectrometer. However, embodiments that utilize multiple sets of channels can also be constructed. Refer now to FIG. 11, which illustrates an input port according to another embodiment of the present invention. Input port 111 includes two channel plates 105 and 106 that are separated by a region 102. The channels can have the same geometry or different geometries.

For example, channel plate 106 could have a different number of channels and utilize different electrode spacings. The two sets of channels can also be operated at different RF voltages and frequencies. The pressure in region 102 is intermediate between the pressure in the ion source region 101 and that in the interior region 103 of the mass spectrometer. Hence, channel plate 106 can operate at a lower pressure drop than channel plate 105. The two channel plates can be operated using different waveforms and DC biases, and hence, independent separations/filtrations can be performed in tandem on the sample prior to the sample entering the mass spectrometer.

The above-described embodiments of the present invention operate between atmospheric pressure and the vacuum inside the mass spectrometer, which is typically less than 50 Torr. However, the present invention could be utilized to provide a pressure interface between environments at other pressures. For example, the higher pressure environment could be partially evacuated or under pressure. For example, the higher pressure environment could be at or greater than 2, 1.5, 1.25, 1, 0.75, 0.5, 0.25, or 0.1 atmospheres, while the lower pressure environment could be at a pressure that differs from the high pressure environment by a pressure difference from 1 Torr to 2 atmospheres. In one aspect of the present invention, the interface operates between a pressure that is greater than 50 Torr and less than 50, 30, 20, 10, 5 or 1 Torr within the mass spectrometer.

The above-described embodiments refer to a number of apertures through which ions pass. It should be noted that these apertures can be defined by a physical element such as a hole in a solid structure or merely be regions of space that lack physical boundaries but through which the ions must pass to be processed in the described manner.

The Summary of the Invention and the above-described embodiments of the present invention have been provided to illustrate various aspects of the invention. However, it is to be understood that different aspects of the present invention that are shown in different specific embodiments can be combined to provide other embodiments of the present invention. In addition, various modifications to the present invention will become apparent from the foregoing description and accompanying drawings. Accordingly, the present invention is to be limited solely by the scope of the following claims.

What is claimed is:

1. A device comprising:

a chamber adapted to operate at a first pressure, said chamber comprising a wall that separates said chamber from an outside environment at a second pressure, said first pressure being less than said second pressure;

an input port that provides a pressure drop between said outside environment and said chamber when said chamber is at said first pressure, said input port comprising a plurality of channels, each channel having first and second electrodes arranged on opposing surfaces of that channel and having first and second ends, said first end being at said second pressure and in fluid communication with said outside environment and said second end being at said first pressure and being in fluid communication with said chamber allowing ions to pass therethrough; and a drive circuit that applies a potential to said first and second electrodes in each of said channels.

2. The device of claim 1 wherein said chamber comprises a mass spectrometer.

3. The device of claim 1 wherein said first pressure is greater than 50 Torr and said second pressure is less than 50 Torr.

4. The device of claim 2 wherein said mass spectrometer is characterized by a mass spectrometer input aperture within said chamber through which ions pass to be analyzed by said mass spectrometer and wherein said input port comprises a port input aperture that defines an area over which ions are collected by said input port and delivered toward said chamber, said port input aperture being greater than said mass spectrometer input aperture.

5. The device of claim 2 wherein said drive circuit creates a time-varying electric field in each of said channels.

6. The device of claim 5 wherein said time-varying electric field has an AC component and a constant component whose magnitude is set by an input from a user of said mass spectrometer.

7. The device of claim 5 wherein said input port further comprises a drift region in which ions traveling therein are not subjected to said alternating electric field.

8. The device of claim 7 wherein said drift region comprises a region in each of said channels in which ions traveling therein are not subjected to said alternating electric field.

9. The device of claim 5 wherein said time-varying electric field has an amplitude that varies along said channel in a manner that depends on a density of gas in said channel as a function of position in said channel.

10. The device of claim 7 wherein said drift region is characterized by a pressure drop across said drift region greater than 10 percent of the difference between said first and second pressures.

11. The device of claim 2 wherein each of said electrodes comprises a first electrical connection at a first point on said electrode and a second electrical connection at a second point on said electrode, said first and second points being spaced apart, and wherein said mass spectrometer further comprises a power source connected to said first and second points, said power source creating a potential gradient between said first and second points.

12. The device of claim 11 wherein said first point is proximate to said first end of said electrode and wherein said DC potential gradient is chosen such that ions are attracted to said first end of each electrode.

13. The device of claim 1 wherein said input port comprises an orifice in said chamber wall and a removable channel plate that attaches to said chamber wall, said channel plate comprising said channels.

14. The device of claim 4 wherein said input port further comprises an ion concentrating section that receives ions from said channels and concentrates said ions into said mass spectrometer input aperture.

15. The device of claim 2 further comprising an ion source that generates ions from a sample, said ion source outputting ions at said second pressure such that said ions are input to said input port.

16. The device of claim 15 wherein said ion source is at a potential that does not pose a hazard to a human and wherein said first ends of said channels are at a potential that attracts ions of interest.

17. A method for analyzing a sample, said method comprising:

forming ions from said sample in an ion source; and providing a mass spectrometer having an input port that receives some of said ions through an input port, said input port comprising a plurality of channels through which said ions pass, each channel having first and second electrodes arranged on opposing surfaces of that channel and having first and second ends, said first end being at a first pressure and said second end being at a second pressure where said second pressure is less than said first pressure, said input port being positioned to receive ions from said ion source.

18. The method of claim 17 further comprising generating time-varying electric fields in said channels.

19. The method of claim 18 wherein said time-varying electric fields include an AC component and constant component within said channels, said constant component having a magnitude set by an input from a user of said mass spectrometer.

20. The method of claim 17 wherein each of said electrodes comprises a first electrical connection at a first point on said electrode and a second electrical connection at a second point on said electrode, said first and second points being spaced apart, and wherein said method further comprises creating a potential gradient between said first and second points.

* * * * *